US006049034A

United States Patent [19]

Cook

[11] Patent Number: 6,049,034

[45] Date of Patent: Apr. 11, 2000

[54] MUSIC SYNTHESIS CONTROLLER AND METHOD

[75] Inventor: Perry R. Cook, Princeton, N.J.

[73] Assignee: Interval Research Corporation, Palo Alto, Calif.

[21] Appl. No.: 09/233,690

[22] Filed: Jan. 19, 1999

[51] Int. Cl.[7] ..... G10H 5/02

[52] U.S. Cl. ..... 84/736; 84/659

[58] Field of Search ..... 84/600, 622, 659, 84/736, 743

[56] References Cited

U.S. PATENT DOCUMENTS

| | | | |
|---|---|---|---|
| 5,265,516 | 11/1993 | Usa et al. | 84/600 |
| 5,286,913 | 2/1994 | Higashi | 84/622 |
| 5,340,942 | 8/1994 | Kunimoto | 84/736 X |
| 5,396,025 | 3/1995 | Tamura | 84/736 |
| 5,661,253 | 8/1997 | Aoki . | |
| 5,668,340 | 9/1997 | Hashizume et al. . | |

*Primary Examiner*—Jeffrey Donels
*Attorney, Agent, or Firm*—Pennie & Edmonds LLP

[57] ABSTRACT

A music synthesizer has one or more sensors that generate a respective plurality of sensor signals, at least one of which is an audio frequency sensor signal. Electronic circuitry, such as a specialized circuit or a programmed digital signal processor or other microprocessor, implements a physical model. The electronic circuitry includes an excitation signal input port for continuously receiving the audio frequency sensor signal as well as a control signal port for continuously receiving a control signal corresponding to the audio frequency sensor signal. The-control signal can have much lower bandwidth than the audio frequency sensor signal. The electronic circuitry also includes circuitry for generating an audio frequency output signal in accordance with the physical model, utilizing the audio frequency sensor signal received via the excitation signal port as an excitation signal for stimulating the physical model, and using the received control signal to set at least one parameter that controls the generation of the audio frequency output signal. In some implementations, the music synthesizer will include a second sensor for generating a second control signal. The circuitry for generating the audio frequency output signal may include a variable length delay element whose effective delay length is controlled by at least one of the sensor signals.

19 Claims, 2 Drawing Sheets

MUSIC SYNTHESIS CONTROLLER AND METHOD

The present invention relates generally to music synthesis using digital data processing techniques, and particularly to a system and method for enabling a user to control a music synthesizer with gestures such as plucking, striking, muting, rubbing, bowing, slapping, thumping and the like.

BACKGROUND OF THE INVENTION

Musicians are generally not at all satisfied with currently available electronic guitar and violin controllers. This dissatisfaction extends to both professional level and amateur level devices.

Real stringed instruments can be plucked, struck, tapped, rubbed, bowed, muted and so on with one or both hands. Some of these gestures, such as striking and muting, can be combined to create new gestures such as hammer-ons and hammer-offs (alternate striking and muting with one or both hands), slapping, thumping, etc. Although stringed instrument controller and synthesizer systems do afford a wide range of interesting sounds, they do not afford the same range of gestures as an actual acoustic or electric instrument.

FIG. 1 shows a typical guitar controller and synthesizer system 50. This FIGURE shows how a traditional guitar 52 (usually electric, but possibly acoustic) is connected to a conventional synthesizer 54 through a pitch and amplitude detector 56. Through the use of a special electric guitar pickup 56, the pitch and amplitude detection can be replicated for each string, yielding polyphonic (muiti-voice) synthesizer control. The latency required for detecting pitch and amplitude, however, combined with the limitations of using only these two attributes of the instrument sound, are a significant part of the performance problem with traditional controller synthesizer devices. Mapping the detected pitch and amplitude into traditional MIDI (Musical Instrument Digital Interface) messages such as NoteOn, NoteOff, Velocity and PitchBend grossly limit the musician's expressive power when compared with the expressive power they have on a traditional acoustic or electric guitar. In addition, when using the traditional devices, selecting the correct synthesis algorithms and parameter mappings that best utilize the simple MIDI parameters is a difficult task that is beyond the capabilities of many music synthesizer users.

FIG. 1 is also applicable to violin synthesizer control systems (such as the Zeta violin family). Since the violin has bowing parameters as well as continuous pitch control, systems such as this suffer even more profoundly from the limitations of pitch and amplitude detection, MIDI, and the difficulties of synthesizer algorithm selection and parameterization.

FIG. 2 shows another configuration of a guitar controller 60 and synthesizer 54. This type of controller 60 is not made from a traditional acoustic or electric guitar. Rather, in this type of system, a specialized controller 60 is used that uses sensors to determine such things as finger placement, picking, string bend, and so on. Signals representing these parameters are converted to control messages, usually using MIDI, and sent to a synthesizer 54. Systems such as this can have advantages over the system of FIG. 1, in that they do not introduce the delays associated with pitch and amplitude detection. But such systems still suffer from the limitations of MIDI, and the mismatch between the control paradigm (guitar playing) and the synthesis algorithm.

Neither the system shown in FIG. 1 nor the one shown in FIG. 2 provide the intimacy of control (timing and subtlety of interaction parameters), or the range of means of interaction with the synthesis algorithm, that an actual acoustic or electric guitar provides. Part of the problem stems from the fact that in these systems there is a distinction between "audio signals" and "control signals." While there is a difference of bandwidth, related to the rate of change of a signal, between different control interface locations and modalities in real (e.g., acoustic) instruments, making this distinction artificially and too early in the design process has led to the inadequacy of many synthetic instrument controllers.

It is a goal of the present invention to provide a music synthesizer having minimum latency and in which control and synthesis are merged into one device. Another goal of the present invention is to provide a music synthesizer capable of responding to gestures such as plucking, striking, muting, rubbing, bowing, slapping, thumping and the like. Restated, the synthesizer should be responsive to and the audio frequency output signal it generates should be distinctively responsive to a variety of respective user gestures.

SUMMARY OF THE INVENTION

In summary, the present invention is a music synthesizer having one or more sensors that generate a respective plurality of sensor signals, at least one of which is an audio frequency signal. Electronic circuitry, such as a specialized circuit or a programmed digital signal processor or other microprocessor, implements a physical model. The electronic circuitry includes an excitation signal input port for continuously receiving the audio frequency sensor signal as well as a control signal port for receiving a control signal. The control signal can have much lower bandwidth than the audio frequency sensor signal. The electronic circuitry also includes circuitry for generating an audio frequency output signal in accordance with the physical model, utilizing the audio frequency sensor signal received via the excitation signal port as an excitation signal for stimulating the physical model, and using the received control signal to set at least one parameter that controls the generation of the audio frequency output signal.

In some implementations, the music synthesizer will include a second sensor for generating a second control signal. The circuitry for generating the audio frequency output signal may include a variable length delay element whose effective delay length is controlled by at least one of the sensor signals.

User gestures have associated therewith a position and an amount of force. In some implementations the physical model includes an excitation function that is responsive to a sensor signal indicative of the instantaneous amount of force associated with each user gesture and also includes a variable length delay element that is controlled by the position associated with each user gesture.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENTS

Figure 1:
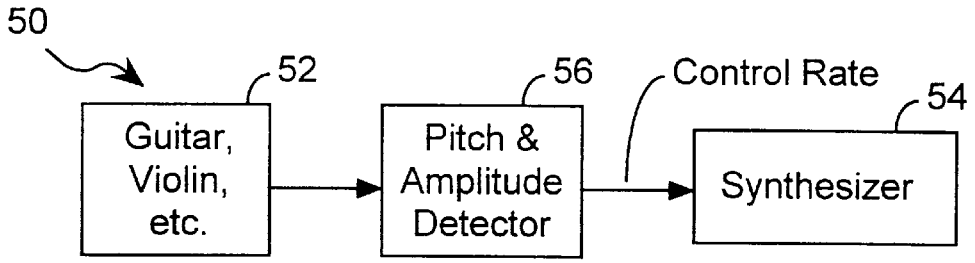
Prior Art Fig. 1
FIG. 1 is a block diagram of a music synthesizer system using a traditional pitch and amplitude detector to send control information to a synthesizer.
Figure 2:
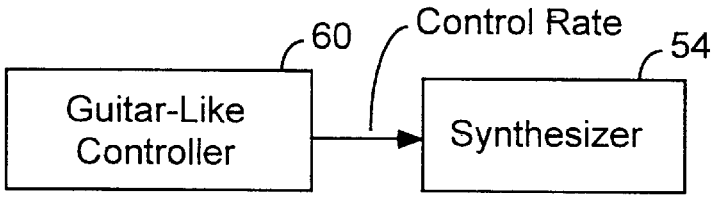
Prior Art Fig. 2
FIG. 2 is a block diagram of a music synthesizer system using a traditional guitar-like controller.
Figure 3:
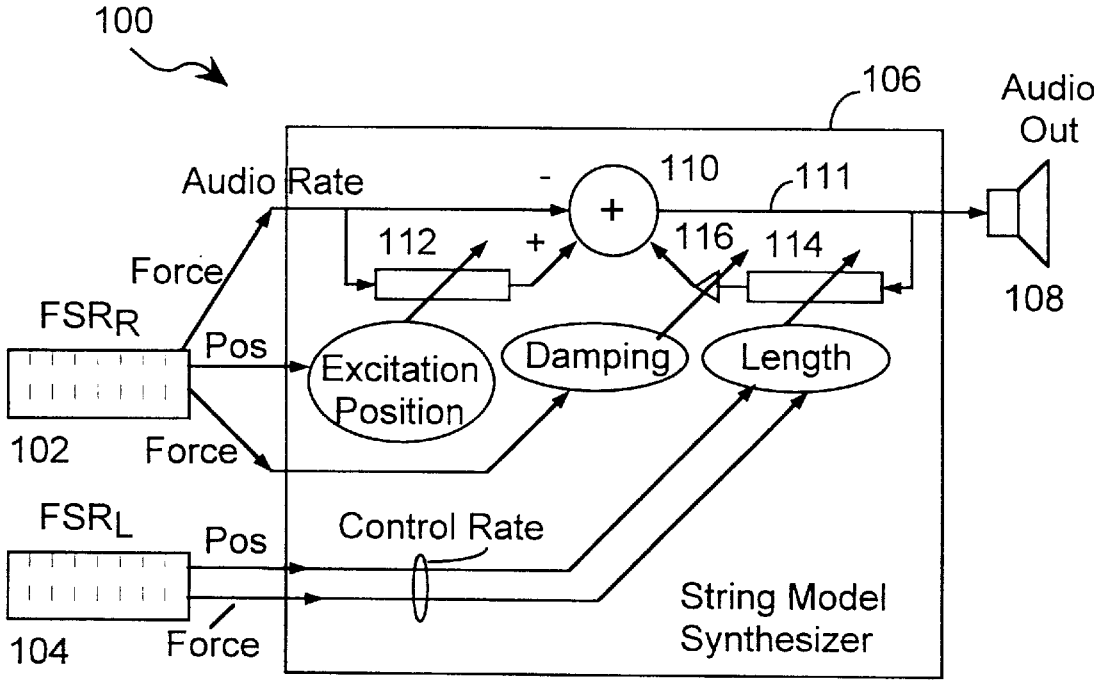
FIG. 3 is a block diagram of a music synthesizer in accordance with the present invention.

Referring to FIG. 3, there is shown a music synthesizer 100 that simulates the operation of a plucked string instrument. The synthesizer 100 uses two force sensitive resistors (FSR's) 102, 104 as the user interface for controlling the music generated. FSR 102 is called the right hand sensor or $FSR_R$ and FSR 104 is called the left hand sensor or $FSR_L$. Each FSR generates two sensor signals: a force signal ($Force_R$ or $Force_L$) indicating the instantaneous amount of pressure being applied to the sensor, and a position signal ($POS_R$ or $POS_L$) indicating the position (if any) along the sensor's main axis at which the sensor is being touched.

When a user touches (or hits, rubs, bows, etc.) an FSR sensor 102, 104 with one of his/her (hereinafter "his", for simplicity) fingers, a digital signal music synthesizer 106 (also called a synthesis model, or a physical model) receives two signals Pos and Force indicative of the position and force with which the user is touching the sensor 102, 104. In the example shown in this document, the physical model 106 is a string model for synthesizing sounds similar to those generated by a guitar or violin string. However, in other implementations of the invention a wide variety of other physical models may be used so as to simulate the operation of other acoustic instruments as well as instruments for which there is no analogous acoustic instrument.

A typical mapping of the FSR signals, used in the embodiment shown in FIG. 3, is as follows:

| | | |
|---|---|---|
| left hand position ($Pos_L$) | controls | pitch |
| left hand pressure ($Force_L$) | controls | pitch bend |
| right hand position ($Pos_R$) | controls | string excitation position (where plucked, struck, etc.) |
| right hand pressure ($Force_R$) | controls | string damping |

In addition, the present invention uses one of the FSR signals (e.g., $Force_R$) as an Audio Rate signal, having a audio frequency bandwidth (i.e., of at least 2 KHz and preferably at least 10 KHz), to directly excite the synthesis model 106. This lends naturally to the control of string synthesis models, allowing rubbing, striking, bowing, picking and other gestures to be used.

By directly controlling a digital signal music synthesizer 106 with the sensor signals, the low bandwidth normally associated with sensor signals in MIDI control applications is overcome.

Sensor signals produced by sensors such as electronic keyboard keys typically have an effective bandwidth of 20 to 50 Hz, which is well below the audio frequency range needed by the present invention for use as a model excitation signal. It is for this reason that the present invention uses at least one sensor, such as the FSR mentioned above, that is capable of producing audio frequency sensor signals.

The digital signal music synthesizer 106 in the embodiment described in this document implements a plucked string model, but differs significantly from traditional models of this type in at least two important ways. A first difference is that the excitation signal for the model is not generated within the synthesis model by an envelope generator, noise source, or loading of a parametric initial state such as shape and/or velocity. Rather, in the present invention the excitation signal is continuously fed into the model from the audio rate (i.e., an audio frequency bandwidth) FSR signal coming from the instrument controller. This allows for the intimate control of gestures such as rubbing, bowing and damping in addition to low-latency picking, striking and the like.

A second difference is that the parameters of the synthesis model are coupled directly to various control signals generated by the controller. An example of this is damping, where pressing hard enough on an FSR causes the string model damping parameter to be changed. Another is pitch bend, where pressure on the another FSR directly causes the physical parameters related to tension to be adjusted in the model. Some of these control signals may be received on a continuous basis, but perhaps at much lower update rate (e.g., 20 Hz to 200 Hz) than the audio rate excitation signal, while other ones of the control signals may be received by the synthesis model only when they change in value (or when the change in value by at least a threshold value).

More specifically, the digital signal music synthesizer 106 includes one resonator loop consisting of an adder 110, a variable length delay line 114, and a signal attenuator 116 connected serially. The output of the adder is an audio rate signal that is transmitted via signal line 111 to an audio output device 108, such as an audio speaker having a suitable digital to analog signal converter at its input. The effective length of the variable length delay line 114 is controlled by the $Force_L$ and $Pos_L$ signals in accordance with an equation such as:

$$\text{Delay Length}=\alpha\cdot Force_L+\beta\cdot POS_L+\delta$$

where $\alpha$, $\beta$ and $\delta$ are predefined coefficients.

Alternately, the effective length of the variable length delay line 114 may be defined as:

$$DelayLength = \begin{cases} \alpha Force_L + \beta Pos_L + \delta, & \text{for } Force_L \geq F_{\min} \\ \delta, & \text{for } Force_L < F_{\min} \end{cases}$$

The aftenuator changes the amplitude of the resonator signal received from the delay line 114 by a factor controlled by the $Force_R$ signal in accordance with an equation such as $$\text{output}=\text{input}\cdot(1-\gamma\cdot Force_R)$$

where $\gamma$ is a predefined scaling coefficient.

The digital signal music synthesizer 106 further includes an excitation signal input to the adder 110 consisting of the Audio Rate signal, which is proportional to the $Force_R$ signal and a delayed version of the Audio Rate signal generated by a variable length delay line 112, where the length of the delay line 112 is controlled by the $POS_R$ signal in accordance with an equation such as:

$$\text{Delay Length}=\zeta\cdot POS_R+\eta$$

where $\zeta$ and $\eta$ are predefined coefficients. The addition of the input signal to a delayed version of itself has the effect of simulating the excitation of a guitar or violin string at a particular position, and it is for this reason that the length of the delay line 112 is controlled by the position of the user gesture associated with $FSR_R$.

Figure 4:
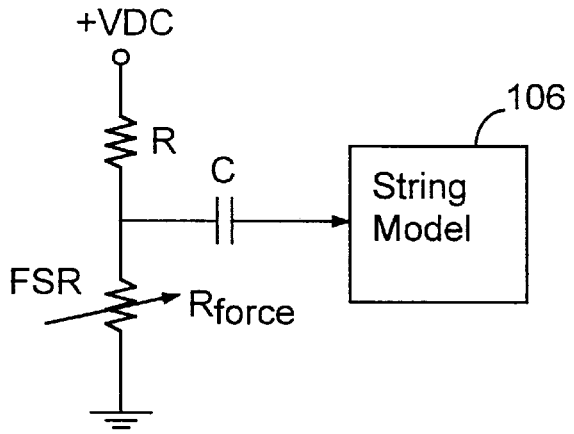
FIG. 4 is a diagram of a voltage divider circuit that includes a force sensitive resistor, a fixed value resistor and a capacitor.

Referring to FIG. 4, the sensor used to generate an excitation signal may be coupled to the string model 106 by a voltage divider circuit that includes a force sensitive resistor (FSR), a fixed value resistor and a capacitor. Any change in the resistance of the FSR causes a change in voltage applied to the input (left) side of the capacitor. The capacitor serves to block any DC voltage from going into the excitation section of the string model 106. Rubbing, striking and other physical gestures applied to the FSR cause audio frequency deviations to be passed to the string model directly as an excitation signal.

In alternate embodiments, the FSR sensor(s) could be replaced by various other types of sensors, including piezoelectric sensors, optical sensors, and the like. A single sensor, or a combination of sensors, can be used to detect both pressure (or proximity) and position so as to yield and audio range signal directly analogous and responsive to rubbing, striking, bowing, plucking or other gestures. For single dimension sensors (such as separate position and pressure sensors), the use of two or more co-located sensors so as to sense two or more aspects of a single gesture is strongly preferred in order to facilitate user control of the simulated instrument.

The mapping of sensor signals into both control and excitation signals can be extended to two or more dimensions, such as a drum head sensor or other two-dimensional surface sensor that can simultaneously sense two or more position parameters, and that can generate an audio rate signal to excite a two-dimensional (or higher dimensional) physical synthesis model.

More generally, the sensors should be able to map the user's physical gestures (touching the sensor) into at least two signals: one for control, which can be low bandwidth, and an excitation signal, which must have a bandwidth at least in the audio signal frequency range (i.e., a bandwidth of at least a 2 KHz, and preferably at least 10 KHz). An excitation signal bandwidth of at least 2 KHz is typically needed so that the circuitry for generating the audio frequency output signal is responsive to and the audio frequency output signal it generates is distinctively responsive to a variety of respective user gestures, including striking, rubbing, slapping, tapping, and thumping the sensor.

Figure 5:
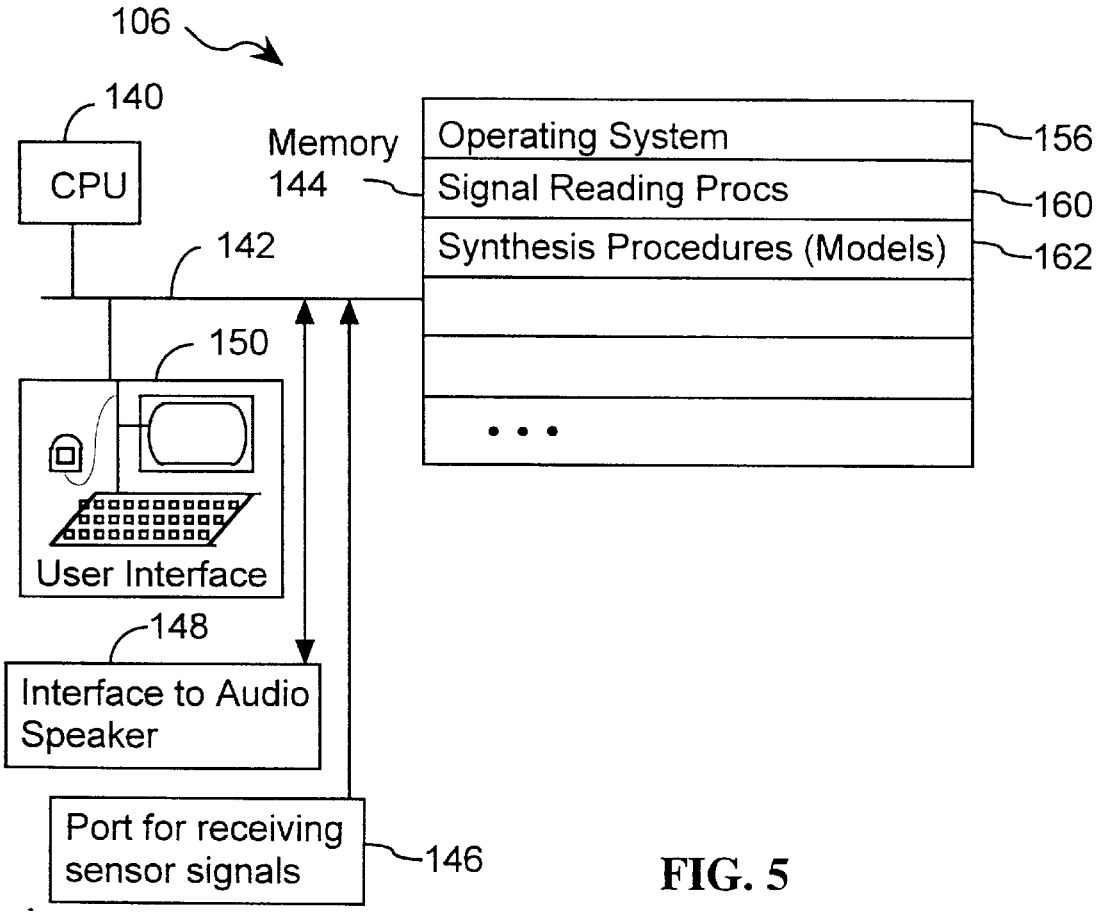
FIG. 5 is a block diagram of a computer based implementation of the present invention.

Referring to FIG. 5, the present invention can be implemented using a general purpose computer, or a dedicated computer one such as in a music synthesizer, as well as with special purpose hardware. In a general purpose computer implementation the digital signal synthesizer 106 will typically include a data processor (CPU) 140 coupled by an internal bus 142 to memory 144 for storing computer programs and data, one or more ports 146 for receiving sensor signals (e.g., from FSR's), an interface 148 to an audio speaker (e.g., including suitable digital to analog signal converters and signal conditioning circuitry), and a user interface 150. The data processor 140 may be a digital signal processor (DSP) or a general or special purpose microprocessor.

The user interface 150 is typically used to select a physical model, which corresponds to a synthesis procedure that defines a mode of operation for the synthesizer 106, such as what type of instrument is to be modeled by the synthesizer. Thus, the user interface can be a general purpose computer interface, or in commercial implementations could be implemented as a set of buttons for selecting any of a set of predefined modes or operation. If the user is to be given the ability to define new physical models, then a general purpose computer interface will typically be needed. Each mode of operation will typically correspond to both a "physical model" in the synthesizer (i.e., a range of sounds corresponding to whatever "instrument" is being synthesized) and a mode of interaction with the sensors.

The memory 144, which typically includes both high speed random access memory and non-volatile memory such as ROM and/or magnetic disk storage, may store:

- an operating system 156, for providing basic system support procedures;
- signal reading procedures 160 for reading the user input signals (also called sensor signals) at a specified audio sampling rate;
- synthesis procedures 162, each of which implements a "physical model" for synthesizing audio frequency output signals in response to one or more excitation signals and one or more control signals. Each of the synthesis models (i.e., procedures) must be capable of responding to physical parameters (i.e., one or more control signals) as well as an audio bandwidth excitation signal.

Another requirement of the implementation shown in FIG. 5 is that the same sensor signal(s) be used to generate both (A) an audio frequency rate excitation signal, as well as (B) at least one control signal, which can vary at a much lower frequency than the excitation signal, for controlling at least one parameter of the physical synthesis model implemented by any selected one of the synthesis procedures 162.

In alternate embodiments the digital signal music synthesizer 106 might be implemented as a set of circuits (e.g., implemented as an ASIC) whose operation is controlled by a set of parameters. Such implementations will typically have the advantage of providing faster response to user gestures.

ALTERNATE EMBODIMENTS

The physical model part of the present invention (but not the sensors) can be implemented as a computer program product that includes a computer program mechanism embedded in a computer readable storage medium. For instance, the computer program product could contain program modules stored on a CD-ROM, magnetic disk storage product, or any other computer readable data or program storage product. The software modules in the computer program product may also be distributed electronically, via the Internet or otherwise, by transmission of a computer data signal (in which the software modules are embedded) on a carrier wave.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A music synthesizer, comprising:

a sensor that generates an audio frequency sensor signal in response to direct stimulation of the sensor by a human user; and electronic circuitry for implementing a physical model, the electronic circuitry including:

an excitation signal input port for continuously receiving the audio frequency sensor signal;

a control signal port for receiving a control signal; and circuitry for generating an audio frequency output signal in accordance with the physical model, utilizing the audio frequency sensor signal received via the excitation signal port as an excitation signal for stimulating the physical model, and using the received control signal to set at least one parameter that controls the generation of the audio frequency output signal.

2. The music synthesizer of claim 1, further including a second sensor for generating a second control signal;

wherein the circuit for generating the audio frequency output signal includes a variable length delay element whose effective delay length is controlled by at least one of the sensor signals.

3. The music synthesizer of claim 1, the control signal corresponds to the audio frequency sensor signal.

4. The music synthesizer of claim 1, further including a second sensor for generating a second control signal;

wherein at least one of the sensor signals corresponds to a position where one of the sensors is touched by a user;

the generated audio frequency output signal has an associated pitch; and the circuit for generating the audio frequency output signal modifies the pitch of the audio frequency output signal in accordance with at least one of the sensor signals that corresponds to a position where one of the sensors is touched by a user.

5. The music synthesizer of claim 1, wherein the sensor senses both pressure and position and generates a first sensor signal corresponding to a position at which it is touched by a user and a second sensor signal corresponding to how much pressure is being applied to the sensor by the user;

the generated audio frequency output signal has an associated pitch; and the circuit for generating the audio frequency output signal modifies the pitch of the audio frequency output signal in accordance with at least the first sensor signal, and adjusts at least one control parameter that controls generation of the audio frequency output signal in accordance with the second sensor signal.

6. The music synthesizer of claim 5, wherein the second sensor signal is the audio frequency sensor signal used as the excitation signal for stimulating the physical model; and the circuit for generating the audio frequency output signal is responsive to and the generated audio frequency output signal it generates is distinctively responsive to a variety of respective user gestures, including striking, rubbing, slapping, tapping, and thumping the sensor.

7. A music synthesizer, comprising:

a plurality of sensors, wherein the sensors are configured to generate a respective plurality of sensor signals in response to direct stimulation thereof by a human user;

an input port for receiving the plurality of sensor signals;

an output port for outputting audio signals; and a data processing unit for implementing a music synthesis model that is responsive to the sensor signals and generates the audio signals output at the output port, wherein the music synthesis model includes:

at least one resonator having an associated pitch that is controlled by at least one of the sensor signals;

an excitation function that is directly responsive to at least one of the sensor signals so as make the music synthesizer responsive to user gestures.

8. The music synthesizer of claim 7, wherein the excitation function includes a variable length delay element that is controlled by at least one of the sensor signals.

9. The music synthesizer of claim 8, wherein the user gestures have associated therewith a position and an amount of force;

the excitation function is responsive to a first sensor signal indicative of the amount of force associated with a user gesture and the variable length delay element is controlled by the position associated with the user gesture.

10. The music synthesizer of claim 7, wherein the music synthesis model includes at least one amplitude control element that is controlled by at least one of the sensor signals.

11. A method of synthesizing music comprising an audio frequency output signal, the method comprising:

continuously receiving at least one sensor signal, including an audio frequency sensor signal, in response to direct user stimulation of one or more sensors;

receiving a control signal; and generating an audio frequency output signal in accordance with a physical model, utilizing the audio frequency sensor signal as an excitation signal for stimulating the physical model, and using the received control signal to set at least one parameter that control s the generation of the audio frequency output signal.

12. The music synthesis method of claim 11, wherein the physical model includes a variable length delay element whose effective delay length is controlled by the control signal, and the control signal corresponds to a second received sensor signal that is distinct from the audio frequency sensor signal.

13. The music synthesis method of claim 11, wherein the first receiving step includes receiving a second sensor signal that corresponds to a position where one of the sensors is touched by a user;

the generated audio frequency output signal has an associated pitch; and the generating step modifies the pitch of the audio frequency output signal in accordance with the second sensor signal.

14. The music synthesis method of claim 11, wherein the first receiving step includes receiving a first sensor signal corresponding to a position at which a first sensor it is touched by a user and receiving a second sensor signal corresponding to how much pressure is being applied to the first sensor by the user;

the generated audio frequency output signal has an associated pitch; and the generating step modifies the pitch of the audio frequency output signal in accordance with at least the first sensor signal, and adjusts at least one control parameter that controls generation of the audio frequency output signal in accordance with the second sensor signal.

15. The music synthesis method of claim 14, wherein the second sensor signal is the audio frequency sensor signal used as the excitation signal for stimulating the physical model; and the generating step is responsive to and the audio frequency output signal it generates is distinctively responsive to a variety of respective user gestures, including striking, rubbing, slapping, tapping, and thumping the sensor.

16. A method of synthesizing music comprising an audio frequency output signal, the method comprising:

receiving a plurality of sensor signals in response to direct user stimulation thereof, at least one of the sensor signals comprising an audio frequency sensor signal that is received continuously; and generating an audio frequency output signal in accordance with a music synthesis model, utilizing the received audio frequency sensor signal as an excitation signal for stimulating the music synthesis model, and using at least one other received sensor signal to set at least one parameter that controls the generation of the audio frequency output signal.

17. The music synthesis method of claim 16, wherein the music synthesis model includes:

at least one resonator having an associated pitch that is controlled by at least one of the sensor signals; and an excitation function that is directly responsive to at least the audio frequency sensor signal so as make the music synthesizer responsive to user gestures.

18. The music synthesis method of claim 17, wherein the user gestures have associated therewith a position and an amount of force;

the music synthesis model includes a variable length delay element that is controlled by at least one of the sensor signals; and the music synthesis model is responsive to a first sensor signal indicative of the amount of force associated with the user gestures and the variable length delay element is controlled by the position associated with the user gestures.

19. The music synthesis method of claim 18, wherein the music synthesis model includes at least one amplitude control element that is controlled by at least one of the sensor signals.

* * * * *